US005591325A

United States Patent [19]

Higashi

[11] Patent Number: 5,591,325

[45] Date of Patent: Jan. 7, 1997

[54] PROCESS FOR HYDROTREATING HEAVY OIL AND HYDROTREATING APPARATUS

[75] Inventor: Hidehiro Higashi, Kitakyushu, Japan

[73] Assignee: Catalysts & Chemicals Industries Co., Ltd., Japan

[21] Appl. No.: 335,886

[22] PCT Filed: Aug. 17, 1994

[86] PCT No.: PCT/JP94/01360

§ 371 Date: Nov. 15, 1994

§ 102(e) Date: Nov. 15, 1994

[87] PCT Pub. No.: WO95/05434

PCT Pub. Date: Feb. 23, 1995

[30] Foreign Application Priority Data

Aug. 18, 1993 [JP] Japan ..... 5-225177

[51] Int. Cl.[6] ..... C10G 45/00

[52] U.S. Cl. ..... 208/251 H; 208/254 H; 208/213; 208/220

[58] Field of Search ..... 208/251 H, 253, 208/210, 58, 216, 220, 254 H, 213

[56] References Cited

U.S. PATENT DOCUMENTS

| | | | |
|---|---|---|---|
| 3,663,434 | 5/1972 | Bridge | 208/251 H |
| 3,936,370 | 2/1976 | Henke et al. | 208/210 |
| 3,964,995 | 6/1976 | Wolk et al. | 208/210 |
| 4,657,664 | 4/1987 | Evans et al. | 208/211 |

FOREIGN PATENT DOCUMENTS

| | | |
|---|---|---|
| 2509549 | 9/1975 | Germany . |
| 49-18764 | 5/1974 | Japan . |
| 53-98308 | 8/1978 | Japan . |
| 54-37105 | 3/1979 | Japan . |
| 1495586 | 12/1977 | United Kingdom . |

*Primary Examiner*—Asok Pal
*Assistant Examiner*—Bekir L. Yildirim
*Attorney, Agent, or Firm*—Webb Ziesenheim Bruening Logsdon Orkin & Hanson, P.C.

[57] ABSTRACT

The present invention provides a process for hydrotreating a heavy oil, comprising the steps of (a) feeding a heavy oil into a fixed-bed reactor packed with a hydrotreating catalyst to thereby effect hydrotreating of the heavy oil, and (b) feeding the heavy oil hydrotreated in the step (a) into a suspended-bed reactor packed with a hydrotreating catalyst for hydrotreating the heavy oil to thereby effect further hydrotreating of the heavy oil, and also provides a hydrotreating apparatus comprising (a') a fixed-bed reactor packed with a catalyst for hydrotreating a feed heavy oil and (b') a suspended-bed reactor packed with a hydrotreating catalyst for hydrotreating the heavy oil hydrotreated in the fixed-bed reactor. The hydrotreating of the heavy oil can be conducted for a prolonged period of time.

15 Claims, 3 Drawing Sheets

PROCESS FOR HYDROTREATING HEAVY OIL AND HYDROTREATING APPARATUS

BACKGROUND OF THE INVENTION

1. Field of the Invention

This application is a 371 of PCT/JP94/01360, Aug. 17, 1994.

The present invention relates to a process for hydrotreating a heavy oil containing, as impurities, metals such as vanadium and nickel and various compounds such as sulfur and nitrogen compounds, and to an apparatus employed therefor.

2. Description of the Prior Art

Processes employing a fixed bed (a), a suspended bed (b) and first a suspended bed and then a fixed bed (c) have been proposed for hydrotreating a heavy oil containing, as impurities, metals such as vanadium and nickel and various compounds such as sulfur and nitrogen compounds.

The above processes have the following drawbacks.

(a) Drawbacks of the process in which a heavy oil is hydrotreated with a fixed bed The process having predominantly been employed for hydrotreating a heavy oil is one using a fixed bed. For example, this process comprises hydrotreating in a fixed-bed reactor having a first reaction chamber packed with a hydrodemetallization catalyst into which a heavy oil is fed to thereby hydrotreat the same and a second reaction chamber packed with a hydrodesulfurization catalyst in which the thus hydrotreated heavy oil is further hydrotreated.

However, when the removal of metals and sulfur and nitrogen compounds from a heavy oil is conducted to a high degree in a fixed-bed reactor, it has occurred that metals resulting from demetallization are converted to sulfides and deposit on the catalyst at the inlet part of the reactor to thereby deactivate the catalyst. Also, it has occurred that the outlet part of the reactor comes to have a high temperature due to the heat of reaction to thereby cause asphaltene at that part to suffer from thermal decomposition so as to produce coke which forms a solidified carbon compound known as a dry sludge to deposit on the catalyst, so that the catalyst is deactivated. Further, deposition of the dry sludge has occurred in pipes arranged downstream of the reactor.

Therefore, the process in which a heavy oil is hydrotreated with a fixed bed has had a drawback in that it is difficult to conduct the hydrotreating operation for a prolonged period of time.

(b) Drawbacks of the process in which a heavy oil is hydrotreated with a suspended bed Known processes in which a heavy oil is hydrotreated with a suspended bed include the H-oil process.

When the hydrotreating of a heavy oil is conducted only with a suspended bed, although the reaction temperature can be kept uniform, there has been a drawback in that the efficiency of utilization of the catalyst is poor, so that the reaction temperature must be increased for reducing the sulfur and nitrogen content of the product oil to a low level with the result that thermal decomposition, rather than nuclear hydrogenation, is advanced to thereby degrade the product oil.

(c) Drawbacks of the process in which a heavy oil is hydrotreated first with a suspended bed and then with a fixed bed This process comprises the steps of first hydrotreating a heavy oil with a suspended bed and then hydrotreating the resultant heavy oil with a fixed bed. This process is aimed at preventing the deactivation of the catalyst caused by deposition of metals on the catalyst so as to prolong the hydrotreating operation period.

This process has drawbacks similar to those of the process in which a heavy oil is hydrotreated with a fixed bed. For example, in this process, coke unfavorably forms a dry sludge, which deposits on the catalyst to thereby deactivate the catalyst. Therefore, in this process, it is difficult to prolong the hydrotreating operation period.

In any of the above conventional processes for hydrotreating a heavy oil, it is requisite to discontinue the hydrotreating operation every about 10 months and to replace the employed catalyst with fresh one. This replacement takes a period as long as 10 to 30 days when the apparatus is for commercial purposes.

The inventors have noted that impurities contained in a heavy oil such as compounds containing vanadium, nickel and other metals, sulfur and nitrogen compounds have different reactivities with hydrogen during hydrotreating depending upon the impurities contained in different heavy oil fractions, such as resin and asphaltene, and found that, when impurities contained in the asphaltene or the like and having low reactivities with hydrogen are forcibly removed together with impurities contained in the resin or the like and having high reactivities with hydrogen to a high degree during the hydrotreating in a fixed-bed reactor, the fractions containing impurities having low reactivities with hydrogen are converted to coke, which deposits on the catalyst to thereby deactivate the catalyst with the result that the long-term hydrotreating operation becomes difficult. The present invention has been completed on the basis of this finding.

The objective of the present invention is to provide a novel process for hydrotreating a heavy oil, which permits prolongation of the hydrotreating operation period, and to provide a novel apparatus suitable therefor.

SUMMARY OF THE INVENTION

The process for hydrotreating a heavy oil according to the present invention comprises the steps of:

(a) feeding a heavy oil into a fixed-bed reactor packed with a hydrotreating catalyst to thereby effect hydrotreating of the heavy oil, and (b) feeding the heavy oil hydrotreated in the step (a) into a suspended-bed reactor packed with a hydrotreating catalyst for hydrotreating the heavy oil to thereby effect further hydrotreating of the heavy oil.

The hydrotreating apparatus of the present invention comprises:

(a') a fixed-bed reactor packed with a catalyst for hydrotreating a feed heavy oil and (b') a suspended-bed reactor packed with a hydrotreating catalyst for hydrotreating the heavy oil hydrotreated in the fixed-bed reactor.

DESCRIPTION OF THE PREFERRED EMBODIMENT

Figure 1:
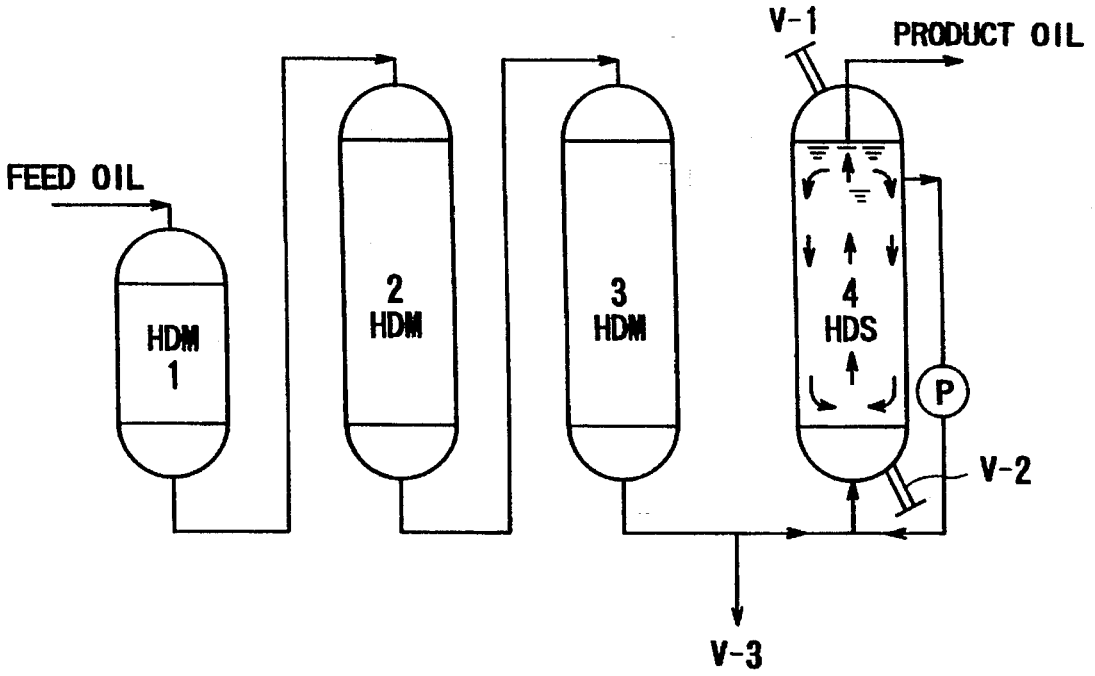
FIG. 1 is an explanatory view for illustrating the reaction steps and apparatus employed in Example 1.

The process for hydrotreating a heavy oil according to the present invention comprises the steps of:

(a) feeding a heavy oil into a fixed-bed reactor packed with a hydrotreating catalyst to thereby effect hydrotreating of the heavy oil, and (b) feeding the heavy oil hydrotreated in the step (a) into a suspended-bed reactor packed with a hydrotreating catalyst for hydrotreating the heavy oil to thereby effect further hydrotreating of the heavy oil.

The heavy oil employed as the feed oil in the process of the present invention is a hydrocarbon oil having a fraction with a boiling point higher than 343° C. in an amount of at least 80% in which vanadium and nickel are contained in a total amount of 30 ppm or greater. In particular, examples of the above hydrocarbon oils include crude oil, atmospheric distillation residue oil and vacuum distillation residue oil.

It is preferred that the heavy oil be hydrotreated in the step (a) so that vanadium and nickel (V+Ni) be removed from the heavy oil at a demetallization rate of not greater than 80%, preferably from 5 to 80% more preferably from 30 to 70% by weight based on the weight of the total of vanadium and nickel (V+Ni) contained in the heavy oil before hydrotreating.

When the step (a) is conducted under such severe conditions that the demetallization rate exceeds 80% by weight, it is likely that the asphaltene contained in the heavy oil is decomposed by heat to thereby cause side chains to detach from condensed aromatic rings of the asphaltene, so that the asphaltene can no longer maintain its micelle state to decompose in the form of radical-group-having condensed aromatic rings with the result that a dry sludge occurs. Also, it is likely that the asphaltene is cracked by heat to produce coke, which deposits on the catalyst to thereby deactivate the catalyst with the result that the hydrotreating operation for a prolonged period of time becomes unfeasible.

The hydrotreating catalyst employed in the above step (a) is preferably one composed of a hydrogenation metal component and an inorganic oxide carrier, having the following properties:

| | Range | Still preferred range |
|---|---|---|
| Pore volume (P.V) | at least 0.40 ml/g | 0.50–1.00 ml/g |
| Average pore diameter (P.D) | at least 90 Å | 90–2000 Å |
| Specific surface area (S.A) | at least 120 $m^2/g$ | 130–350 $m^2/g$ |
| Average diameter of catalyst particles (Dia) | at least 1/32 inch | 1/22–1/4. inch |

Examples of the above hydrogenation metal components include metals of the groups VIA, VIII and V of the periodic table which are employed in the conventional hydrotreating catalyst, such as cobalt, nickel, molybdenum and tungsten.

For use, the above hydrogenation metal component is carried on an inorganic oxide carrier in the conventional amount, preferably in an amount of 3 to 30% by weight.

Examples of the above inorganic oxide carriers include those conventionally employed as the hydro-treating catalyst carrier, such as alumina, silica and silica-alumina.

The heavy oil is preferably hydrotreated in the step (a) under the following conditions so that vanadium and nickel (V+Ni) are removed from the heavy oil at a demetallization rate of not greater than 80% by weight based on the weight of the total of vanadium and nickel (V+Ni) contained in the heavy oil before hydrotreating as mentioned above.

| | | Range | Still preferred range |
|---|---|---|---|
| Reaction temperature | (°C.) | 320–410 | 340–390 |
| Reaction hydrogen pressure | ($kg/cm^2$) | 50–250 | 100–200 |
| Liquid space velocity | ($hr^{-1}$) | 0.1–2.0 | 0.3–1.5 |
| Ratio of hydrogen to oil | ($nM^3/kl$) | 300–1200 | 400–1000. |

The effects desired in the present invention may not be obtained when the hydrotreating is conducted under the conditions falling outside the above ranges.

When the hydrotreating is conducted under the conditions falling below the above lower limits, the reaction may not proceed at a desired level to thereby render inevitable hydrotreating of the heavy oil in the step (b) under severe conditions, so that the effects desired in the present invention cannot be attained. On the other hand, when the hydrotreating is conducted under the conditions exceeding the above upper limits, the hydrotreating reaction may advance to an excess extent to thereby greatly promote the coke deactivation of the catalyst in the step (a), so that the life of the catalyst is shortened.

In the present invention, although the step (a) may be carried out with the use of a single fixed-bed reactor, it is preferably conducted with the use of at least two fixed-bed reactors.

Below, description will be made with respect to the step in which the heavy oil hydrotreated in the step (a) is fed into a suspended-bed reactor packed with a hydrotreating catalyst to thereby effect further hydrotreating of the heavy oil, namely, the step (b).

The suspended-bed reactor to be used in the step (b) may be the conventional suspended-bed reactor as well as a moving-bed reactor or a ebullated reactor.

In the step (b) of the process of the present invention, it is preferred that metals and sulfur and nitrogen compounds contained as impurities in a fraction of the heavy oil hydrotreated in the step (a) which has low reactivity with hydrogen, e.g., asphaltene be highly removed.

That is, in the step (b) of the process of the present invention, it is preferred that the heavy oil hydrotreated in the step (a) be further hydrotreated so that the resultant heavy oil has a content of metal, sulfur and nitrogen components smaller than that of the heavy oil hydrotreated in the step (a).

In the step (b), even if the heavy oil hydrotreated in the step (a) is further hydrotreated so as to highly remove metals, sulfur and nitrogen from the heavy oil with the result that the catalyst is deactivated, it is feasible to withdraw the deactivated catalyst from the suspended-bed reactor or to feed a fresh catalyst into the suspended-bed reactor in accordance with the degree of deactivation of the catalyst, without the need of discontinuing the operation of the suspended-bed reactor. Thus, continuous hydrotreating operation is ensured for a prolonged period of time.

That is, in the step (b) of the process of the present invention, part of the hydrotreating catalyst employed in the hydrotreating of the heavy oil may be withdrawn from the suspended-bed reactor after conducting the hydrotreating of the heavy oil for a given period of time, followed by feeding of a fresh catalyst in an amount equivalent to that of the withdrawn catalyst into the suspended-bed reactor in order to keep the catalyst activity constant.

The impurities having low reactivities with hydrogen, contained in the heavy oil must also be removed for finally obtaining a product oil of high quality.

In the conventional process comprising hydrotreating the heavy oil only with the use of the suspended bed, impurities having high reactivities with hydrogen and impurities having low reactivities with hydrogen are simultaneously removed under severe conditions, so that not only does the deposition of metals on the catalyst occur in a large amount but also the fraction containing impurities having high reactivities with hydrogen undergoes excess decomposition to thereby cause coke deactivation of the catalyst.

By contrast, in the process of the present invention, impurities having high reactivities with hydrogen may mainly be removed during the hydrotreating of the heavy oil in the step (a), and thus the catalyst of the suspended-bed reactor may mainly be used for the removal of impurities having low reactivities with hydrogen during the hydrotreating of the heavy oil in the step (b). When the catalyst of the suspended-bed reactor is effectively utilized in the removal of impurities having low reactivities with hydrogen as mentioned above, nuclear hydrogenation reaction of the heavy oil is promoted.

In the process of the present invention, the degradation of the product oil can be prevented by promoting the nuclear hydrogenation reaction of the heavy oil in the above manner.

The hydrotreating catalyst employed in the above step (b) is preferably a highly active catalyst composed of a hydrogenation metal component and an inorganic oxide carrier, having the following properties:

| | Range | Still preferred range |
|---|---|---|
| Pore volume (P.V) | at least 0.50 ml/g | 0.55–1.10 ml/g |
| Average pore diameter (P.D) | at least 70 Å | 80–500 Å |
| Specific surface area (S.A) | at least 120 $m^2/g$ | 150–400 $m^2/g$ |
| Average diameter of catalyst particles (Dia) | under ⅛ inch | 1/32–1/16. inch |

The catalyst having the same composition as that of the catalyst employed in the step (a) may be used in the step (b).

For performing highly effective hydrotreating of the feed heavy oil, it is preferred that the hydro-treating in the step (b) be conducted under the following conditions:

| | | Range | Still preferred range |
|---|---|---|---|
| Reaction temperature | (°C.) | 350–450 | 380–430 |
| Reaction hydrogen pressure | ($kg/cm^2$) | 50–250 | 100–240 |
| Liquid space velocity | ($hr^{-1}$) | 0.2–10.0 | 0.25–8.0 |
| Ratio of hydrogen to oil | ($nM^3/kl$) | 500–3000 | 800–2500 |
| Ratio of catalyst to oil | (vol/vol) | 1/10–5/1 | 1/8–4/1. |

The effects desired in the present invention may not be obtained when the hydrotreating is conducted under the conditions falling outside the above ranges.

When the hydrotreating is conducted under the conditions falling below the above lower limits, the removal of impurities having low reactivities may not reach a desired level. On the other hand, when the hydrotreating is conducted under the conditions exceeding the above upper limits, the thermal cracking of the heavy oil may preferentially be advanced to thereby degrade the quality of the product oil.

In the present invention, the above step (b) may be conducted with the use of one or at least two suspended-bed reactors.

Below, description will be made with respect to the apparatus for hydrotreating a heavy oil according to the present invention.

The hydrotreating apparatus of the present invention comprises:

(a') a fixed-bed reactor packed with a catalyst for hydrotreating a feed heavy oil and (b') a suspended-bed reactor packed with a hydrotreating catalyst for further hydrotreating the heavy oil hydrotreated in the fixed-bed reactor.

The above step (a) of the process of the present invention can be conducted with the use of the fixed-bed reactor (a') mentioned just above, and the above step (b) of the process of the present invention can be conducted with the use of the suspended-bed reactor (b') mentioned just above.

This suspended-bed reactor is preferably provided with a catalyst withdrawal port through which part of the hydrotreating catalyst may be withdrawn from the suspended-bed reactor, and also with a catalyst feed port through which the hydrotreating catalyst may be fed into the suspended-bed reactior.

As described above, the process of the present invention can be performed with the use of the apparatus for hydrotreating a heavy oil according to the present invent ion.

The present invention will be illustrated in greater detail with reference to the following Examples.

EXAMPLE 1

The atmospheric distillation residue oil specified in Tables 3 and 4 as a feed oil was subjected to a high-degree hydrotreating reaction test through the reaction process shown in FIG. 1 for a prolonged period of time.

Illustratively, the three fixed-bed reactors were packed with the catalyst for step (a) HDM-A having the properties specified in Tables 1 and 2 according to the densely packing technique, and the suspended-bed reactor was installed which permitted feeding thereinto and withdrawal therefrom of the catalyst for step (b). In this suspended-bed reactor, the flow rate of the heavy oil was regulated so as to cause the catalyst fed in the suspended-bed reactor to be in the suspended state by recycling part of the heavy oil hydrotreated in the step (b) with the use of a high-pressure pump.

The suspended-bed reactor was packed with the catalyst HDS-A specified in Tables 1 and 2 as the catalyst for step (b). This catalyst was sulfidized at 290° C. for 48 hr with the use of an untreated straightrun light oil, which was replaced by the feed oil to thereby carry out hydrotreating of the feed oil. The same sulfidization of the catalyst was conducted in the Comparative Examples as well.

In this Example, 72% by volume of the total catalyst was used in the fixed-bed reactors, and 28% by volume thereof was used in the suspended-bed reactor.

Figure 2:
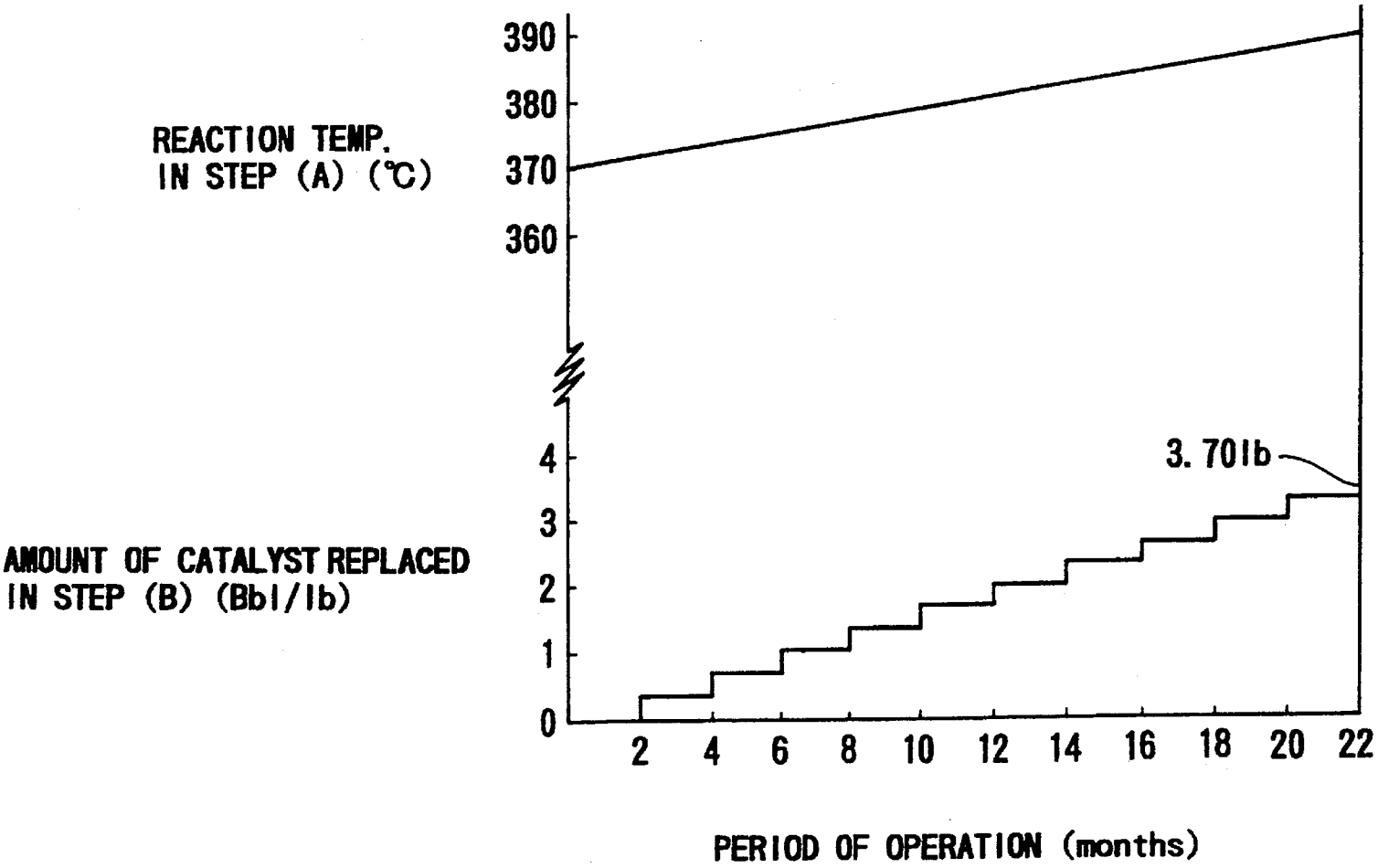
FIG. 2 is a diagram for illustrating the characteristics of operation of Example 1 in which hydrotreating was conducted for a period of 22 months.

In the step (a), the heavy oil was hydrotreated while regulating the reaction temperature as indicated in FIG. 2 so as to cause the (V+Ni) demetallization rate of the product oil to be kept at 45–47%, under the conditions such that the hydrogen pressure was 150 kg/cm$^2$, the LHSV was 0.2 hr$^{-1}$, and the $H_2$/HC was 700 nM$^3$/kl. Accordingly, in the three fixed-bed reactors employed in the step (a), the temperature difference between the inlet of the fixed-bed reactor 1 and the outlet of the fixed-bed reactor 3 as shown in FIG. 1 was regulated at 22° C., and the outlet of the fixed-bed reactor 3 was fitted with a sampling port V-3. The hydrotreated heavy oil was sampled from the outlet of the fixed-bed reactor 3 and analyzed according to necessity, and the conditions were so set as to remove only impurities having high reactivities with hydrogen.

In the suspended-bed reactor employed in the step (b), the catalyst was suspended in the heavy oil hydrotreated in the step (a), and, while maintaining the suspended state, a high-degree hydrotreating of the heavy oil was performed at a reaction temperature kept at 395° C. for a prolonged period of time under the conditions such that the hydrogen pressure was 150 kg/cm$^2$, the LHSV was 0.2 hr$^{-}$, and the $H_2$/HC was 700 nM$^3$/kl, so that the sulfur content of the $C_5^+$ fractions (fractions each having at least 5 carbon atoms) of the heavy oil hydrotreated in the step (b) was 0.3% by weight. The catalyst incorporated in the suspended-bed reactor and used in the step (b) was withdrawn through a catalyst withdrawal port V-2 disposed at a lower part of the suspended-bed reactor 4 as shown in FIG. 1 in an amount corresponding to the degree of deactivation of the catalyst, and fresh catalyst was fed through a catalyst feed port V-1 disposed at an upper part of the suspended-bed reactor 4 in an amount equal to that of the withdrawn catalyst.

A fixed amount of the catalyst was withdrawn from the suspended-bed reactor and fresh catalyst was fed thereinto every two months as indicated in FIG. 2. The total amount of catalyst used for a period of 22 months was 5.13 lb.

In this Example, the hydrotreating was started in the presence of 1.03 lb of catalyst in the step (a) and 0.40 lb of catalyst in the step (b), and a total of 10 catalyst replacements were carried out each in an amount of 0.37 lb from two months thereafter, while the amount of heavy oil passed for hydrotreating was 19.72 Bbl, so that, in the total, the amount of heavy oil hydrotreated per weight of the catalyst was 3.84 Bbl/lb.

The characteristics of heavy oil hydrotreated in this Example for a period of 22 months are shown in FIG. 2. The properties of first-stage and final product oils at one month from the start of heavy oil hydrotreating run (SOR) on the one hand and at one month before the end of heavy oil hydrotreating run (EOR) on the other hand are shown in Tables 3 and 4, respectively.

COMPARATIVE EXAMPLE 1

Figure 3:
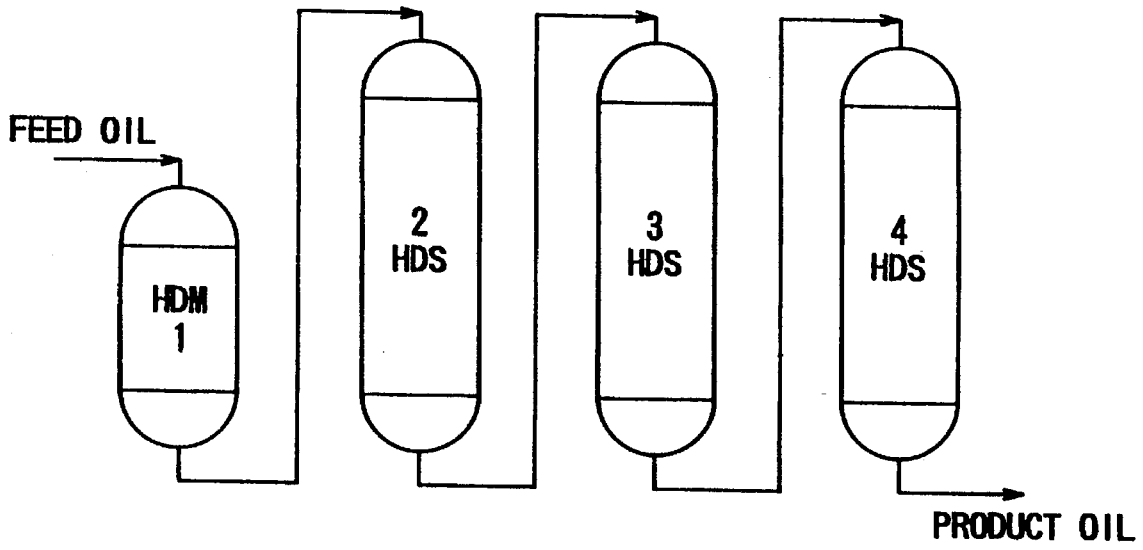
FIG. 3 is an explanatory view for illustrating the reaction steps and apparatus employed in Comparative Example 1.

Four conventional fixed-bed reactors were employed as shown in FIG. 3, and the difference between the temperature of the inlet of the fixed-bed reactor 1 and the temperature of the fixed-bed reactor 4 was adjusted to 30° C. Hydrotreating catalyst for step (a) HDM-A was charged into the fixed-bed reactor 1 and an upper part of the fixed-bed reactor 2, and hydrotreating catalyst for step (b) HDS-A was charged into a lower part of the fixed-bed reactor 2 and the fixed-bed reactors 3 and 4. Hydrotreating durability test was started while changing the reaction temperature under the same conditions as in the step (a) of Example 1 so as to cause the sulfur content of the product oil to be 0.30% by weight.

More specifically, hydrotreating catalyst for step (a) HDM-A specified in Tables 1 and 2 was charged into the fixed-bed reactor 1 and an upper part of the fixed-bed reactor 2 in respective amounts f 16% and 4% by volume, and hydrotreating catalyst for step (b) HDS-A specified in Tables 1 and 2 was charged into a lower part of the fixed-bed reactor 2 and the fixed-bed reactors 3 and 4 in respective amounts of 24%, 28% and 28% by volume. Then, hydrotreating of the heavy oil was carried out.

However, the reaction temperature (WAT) became 400° C. when the amount of hydrotreated heavy oil was 1.92 Bbl/lb at 2000 hr of heavy oil passage for hydro-treating, thereby resulting in the formation of dry sludge. Thus, the conditions were changed so as to cause the sulfur content of the product oil to be 0.6% by weight, and the hydrotreating of the heavy oil was continued. However, the catalyst layer had a pressure drop inside the same at 4000 hr (lapse of 166 days) and at 3.83 Bbl/lb, so that the durability test was discontinued.

COMPARATIVE EXAMPLE 2

The suspended-bed reactor 4 shown in FIG. 1 given in the Example was installed before the reactor 1, and HDM-A specified in Tables 1 and 2 was charged thereinto in an amount of 0.37 lb/two months. Catalyst HDS-A was charged into the remaining reactors 1, 2 and 3. Then, the hydrotreating of the heavy oil was conducted with the result that the durability was found to be only 4 months.

TABLE 1

| Properties of Hydrotreating Catalyst | | |
|---|---|---|
| | Catalyst for Step (a) HDM-A | Catalyst for Step (b) HDS-A |
| Size of Catalyst (inch) | 1/22 (cylindrical) | 1/22 (cylindrical) |
| Apparent Bulk Density (ABD) (g/ml) | 0.55 | 0.55 |
| Bulk Density (CBD) (g/ml) | 0.65 | 0.65 |
| Specific Surface Area (S.A.) (m$^2$/g) | 192 | 220 |
| Pore Volume (P.V.) (ml/g) | 0.60 | 0.60 |
| Pore Diameter (P.D.) (Å) | 125 | 110 |

TABLE 2

| Properties of Hydrotreating Catalyst | | |
|---|---|---|
| | Catalyst for Step (a) HDM-A | Catalyst for Step (b) HDS-A |
| $MoO_3$ (wt %) | 6.5 | 10.5 |
| CoO (wt %) | 1.5 | 0.9 |
| NiO (wt %) | 1.5 | 1.5 |
| $V_2O_5$ (wt %) | 4.5 | 0 |

TABLE 3

| | | SOR[1)] | |
|---|---|---|---|
| | Feed Oil | Reaction Product Oil of Step (a) | Reaction Product Oil of Step (b) |
| Density (15° C. g/ml) | 0.990 | 0.934 | 0.921 |
| Sulfur (wt %) | 4.08 | 0.65 | 0.30 |

TABLE 3-continued

| | Feed Oil | SOR[1] Reaction Product Oil of Step (a) | SOR[1] Reaction Product Oil of Step (b) |
|---|---|---|---|
| Conradson carbon residue (CCR) (wt %) | 15.0 | 6.8 | 2.5 |
| Ni (wt ppm) | 26 | 15 | 3 |
| V (wt ppm) | 91 | 47 | 5 |
| Insoluble Asphaltene in n-Hexane (wt %) | 8.2 | 7.2 | 2.0 |
| Nitrogen (wt ppm) | 2670 | 1602 | 700 |
| Dry sludge (wt %) | 0.0 | 0.0 | 0.01 |
| (Ni + V) Demetallization rate (%) | — | 47.0 | 93.1[2] |

[1]SOR = at the start of run (Start of Run)
[2]Demetallization rate based on feed oil

TABLE 4

| | Feed Oil | EOR[3] Reaction Product Oil of Step (a) | EOR[3] Reaction Product Oil of Step (b) |
|---|---|---|---|
| Density (15° C. g/ml) | 0.990 | 0.930 | 0.920 |
| Sulfur (wt %) | 4.08 | 0.60 | 0.30 |
| Conradson carbon residue (CCR) (wt %) | 15.0 | 6.7 | 3.0 |
| Ni (wt ppm) | 26 | 14 | 4 |
| V (wt ppm) | 91 | 50 | 6 |
| Insoluble Asphaltene in n-Hexane (wt %) | 8.2 | 7.0 | 1.6 |
| Nitrogen (wt ppm) | 2670 | 1670 | 780 |
| Dry sludge (wt %) | 0.0 | 0.0 | 0.01 |
| (Ni + V) Demetallization rate (%) | — | 45.3 | 91.4[4] |

[3]EOR = at the end of run (End of Run)
[4]Demetallization rate based on feed oil

EFFECT OF THE INVENTION

In the present invention, first, the fixed-bed reactor selectively removes impurities contained in resin or the like and having high reactivities with hydrogen at the time of hydrotreating of a heavy oil among impurities contained in the heavy oil. Subsequently, the suspended-bed reactor selectively removes impurities contained in asphaltene or the like and having low reactivities with hydrogen.

Therefore, the present invention can suppress the deactivation of the hydrotreating catalyst in the fixed-bed reactor, so that replacing of the catalyst in the fixed-bed reactor is not necessary for a prolonged period of time. Moreover, continuous catalyst replacement can be performed in the suspended-bed reactor. Thus, as a whole, the period of time in which hydrotreating of the heavy oil is effected can be prolonged.

I claim:

1. A process for hydrotreating a heavy oil where said heavy oil includes metals including vanadium and nickel (V+Ni), said heavy oil further including low reactive impurities having a low reactivity with hydrogen during said hydrotreating process and high reactive impurities having high reactivity with hydrogen during said hydrotreating process, said process comprising:

(a) a first step of feeding a heavy oil into a fixed-bed reactor packed with a hydrotreating catalyst and operating under mild operating conditions to thereby effect hydrotreating of the heavy oil so that vanadium and nickel (V+Ni) are removed from the heavy oil at a demetallization rate of not greater than 80% by weight based on the weight of the total of vanadium and nickel (V+Ni) contained in the heavy oil before hydrotreating, whereupon said high reactive impurities are removed from said heavy oil, followed by (b) a second step of feeding the heavy oil hydrotreated in the step (a) into a suspended-bed reactor packed with a hydrotreating catalyst for hydrotreating the heavy oil and operating under mild operating conditions to thereby effect further hydrotreating of the heavy oil so that said low reactive impurities are removed and the resultant heavy oil has a content of metal, sulfur and nitrogen components smaller than that of the heavy oil hydrotreated in the step (a)

wherein undesirable coke deposition, dry sludge formation and thermal decomposition are avoided and an effective life of said catalyst is prolonged.

2. The process as claimed in claim 1, wherein the hydrotreating in the step (a) is performed under the following conditions:

| | | |
|---|---|---|
| reaction temperature | (°C.) | 320–410 |
| reaction hydrogen pressure | (kg/cm$^2$) | 50–250 |
| liquid space velocity | (hr$^{-1}$) | 0.1–2.0 |
| ratio of hydrogen to oil | (nM$^3$/kl) | 300–1200. |

3. The process as claimed in claim 1, wherein the hydrotreating in the step (b) is performed under the following conditions:

| | | |
|---|---|---|
| reaction temperature | (°C.) | 350–450 |
| reaction hydrogen pressure | (kg/cm$^2$) | 50–250 |
| liquid space velocity | (hr$^{-1}$) | 0.2–10.0 |
| ratio of hydrogen to oil | (nM$^3$/kl) | 500–3000 |
| ratio of catalyst to oil | (vol/vol) | 1/10–5/1. |

4. The process as claimed in claim 1, further including the steps of withdrawing a quantity of catalyst from the suspended-bed reactor corresponding to the degree of deactivation of the catalyst and feeding fresh catalyst into the suspended-bed reactor in an amount substantially equal to the amount of the withdrawn catalyst.

5. The process as claimed in claim 2, further including the steps of withdrawing a quantity of catalyst from the suspended-bed reactor corresponding to the degree of deactivation of the catalyst and feeding fresh catalyst into the suspended-bed reactor in an amount substantially equal to the amount of the withdrawn catalyst.

6. The process as claimed in claim 3, further including the steps of withdrawing a quantity of catalyst from the suspended-bed reactor corresponding to the degree of deactivation of the catalyst and feeding fresh catalyst into the suspended-bed reactor in an amount substantially equal to the amount of the withdrawn catalyst.

7. The process as claimed in claim 2, wherein the hydrotreating in the step (b) is performed under the following conditions:

| | | |
|---|---|---|
| reaction temperature | (°C.) | 350–450 |
| reaction hydrogen pressure | (kg/cm$^2$) | 50–250 |
| liquid space velocity | (hr$^{-1}$) | 0.2–10.0 |
| ratio of hydrogen to oil | (nM$^3$/k1) | 500–3000 |
| ratio of catalyst to oil | (vol/vol) | 1/10–5/1. |

8. The process as claimed in claim 1, wherein the hydrotreating catalyst employed in the step (a) is composed of a hydrogenation metal component selected from the group consisting of metals in the groups VIA, VIII and V of the periodic table and an inorganic oxide carrier, wherein said hydrotreating catalyst employed in the step (a) has a pore volume of at least 0.40 ml/g, an average pore diameter of at least 90Å, a specific surface area of at least 120 m$^2$/g and an average diameter of catalyst particle of at least 1/32 inch.

9. The process as claimed in claim 8, wherein the hydrotreating catalyst employed in the step (a) has a pore volume of 0.50–1.00 ml/g, an average pore diameter of 90–2000Å, a specific surface area of 130–350 m$^2$/g and an average diameter of catalyst particle of 1/22–1/4 inch.

10. The process as claimed in claim 8, wherein the inorganic oxide carrier used for the hydrotreating catalyst employed in the step (a) is selected from the group consisting of alumina, silica and silica-alumina.

11. The process as claimed in claim 8, wherein the hydrogenation metal component used for the hydrotreating catalyst employed in the step (a) is selected from the group consisting of cobalt, nickel, molybdenum and tungsten.

12. The process as claimed in claim 1, wherein the hydrotreating catalyst employed in the step (b) is composed of a hydrogenation metal component and an inorganic oxide carrier, wherein the hydrotreating catalyst employed in the step (b) has a pore volume of at least 0.50 ml/g, an average pore diameter of at least 70Å, a specific surface area of at least 120 m$^2$/g and an average diameter of catalyst particle under 1/8 inch.

13. The process as claimed in claim 12, wherein the hydrotreating catalyst employed in the step (b) has a pore volume of 0.55–1.01 ml/g, an average pore diameter of 80–500Å, a specific surface area of 150–400 m$^2$/g and an average diameter of catalyst particle of 1/32–1/16 inch.

14. The process as claimed in claim 12, wherein the inorganic oxide carrier used for the hydrotreating catalyst employed in the step (b) is selected from the group consisting of alumina, silica and silica-alumina.

15. The process as claimed in claim 12, wherein the hydrogenation metal component used for the hydrotreating catalyst employed in the step (b) is selected from the group consisting of cobalt, nickel, molybdenum and tungsten.

* * * * *